United States Patent [19]

Sakuma et al.

[11] 4,367,636

[45] Jan. 11, 1983

[54] AIR CONDITIONER

[75] Inventors: Kiyoshi Sakuma; Isamu Nakazima; Tetuo Sugiyama, all of Shizuoka, Japan

[73] Assignee: Mitsubishi Denki Kabushiki Kaisha, Tokyo, Japan

[21] Appl. No.: 288,353

[22] Filed: Jul. 30, 1981

[30] Foreign Application Priority Data

Sep. 24, 1980 [JP] Japan ..... 55-135521[U]
Sep. 24, 1980 [JP] Japan ..... 55-135522[U]
Sep. 24, 1980 [JP] Japan ..... 55-135523[U]

[51] Int. Cl.[3] ..... F25D 23/12

[52] U.S. Cl. ..... 62/262; 62/263; 62/428

[58] Field of Search ..... 62/262, 263, 325, 427, 62/428; 165/122

[56] References Cited

U.S. PATENT DOCUMENTS 2,661,606 12/1953 Trask ..... 62/427 X
2,726,518 12/1955 Brugler ..... 62/427 X
3,313,122 4/1967 Laing ..... 62/263
3,802,216 4/1974 Brandimarte ..... 62/26 L
3,871,188 3/1975 Vold et al. ..... 62/262 X
4,240,264 12/1980 Nakada et al. ..... 62/262 X

*Primary Examiner*—Lloyd L. King
*Attorney, Agent, or Firm*—Oblon, Fisher, Spivak, McClelland & Maier

[57] ABSTRACT

An air conditioner comprises a suction grille for sucking air in the room, a heat exchanger placed near and in the rear of said suction grille, an inner casing which is provided with at least two suction inlets, the second inlet being vertically positioned above the first and faces said heat exchanger such that the distance from said heat exchanger to said second suction inlet which is in the lower position is greater than that from said heat exchanger to said first suction inlet which is in the upper position. First and second multiblade type blowers are placed so as to be respectively facing said first and second suction inlets and first and second air passages are provided for feeding air from said first and second blowers into the outlet of said chamber, said second air passage being provided in the rear of the casing of said first blower.

10 Claims, 6 Drawing Figures

AIR CONDITIONER

BACKGROUND OF THE INVENTION

1. Field of the Invention:

The present invention relates to an improvement in an air conditioner having a reduced width and used while standing on a floor; that is, a so called slim type, having a reduced depth.

2. Description of the Prior Art:

FIGS. 1 and 2 show a construction of the conventional slim type air conditioner, wherein a machinery chamber 2, for containing wiring and piping (not shown) therein, is provided at the lower portion of the container 1 of the air conditioner and a suction grille 3, an air filter 4 and a heat exchanger 5 are provided above the machinery chamber 2 in the above order from the front side. A squirrel cage fan is used as a blower 6 and is placed above the heat exchanger 5. The intake openings 7 of the blower 6 are provided to suck air from both sides of the blower, on the front surface of the air conditioner. A motor 9 for the blower is attached to the casing 8 of the blower 6 so that a portion of the motor is held in the blower 6. Above the blower 6 there is provided a chamber 11 through which air is blown into the room.

The conventional air conditioner with the above-mentioned structure has the disadvantage of a large thickness of the casing 8 because the suction inlets 7 are provided at both sides of the blower 6 thereby increasing the depth of the container 1 of the air conditioner.

SUMMARY OF THE INVENTION

It is an object of the present invention to overcome the above disadvantage of the conventional air conditioner and to provide an air conditioner having a reduced depth for the container so that the air conditioner may be smaller than a conventional one while maintaining the width unchanged and without changing the characteristics of noise, output and input etc., so that the area required for the air conditioner can be significantly reduced.

It is another object of the present invention to provide an air conditioner comprising a heat exchanger placed in a substantially vertical position at an intake opening for room air and a plurality of multiblade type blowers with their suction inlets parallel to and at the rear of said heat exchanger, wherein the distance of the air passage from said heat exchanger to said suction inlet of the lower blower is greater than that from the heat exchanger to the suction inlet of the upper blower and the air passage for said lower blower is provided at the rear of the casing of said upper blower.

It is still another object of the present invention to provide an air conditioner comprising a heat exchanger placed in a substantially vertical position at an intake opening for room air, sucked air passages provided at the rear of said heat exchanger, and a plurality of multiblade type blowers with their suction inlets parallel to said heat exchanger, an air passage for the lower blower provided at the rear of the casing of the upper blower and diffusers placed in a blowing chamber to define the air passages for the upper and lower blowers.

In is a further object of the present invention to provide an air conditioner comprising a heat exchanger placed in a substantially vertical position at an intake opening for room air, sucked air passages provided at the rear of said heat exchanger, a plurality of multiblade type blowers with their suction inlets parallel to said heat exchanger, an air passage for the lower blower provided at the rear of the casing of the upper blower, diffusers placed in a blowing chamber to define the air passages for the upper and lower blowers and a partition plate placed in a sucked-air passage to split it into independent sucked-air passages.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

An embodiment of the present invention will be described in detail with reference to FIGS. 3 and 4.

Figure 1:
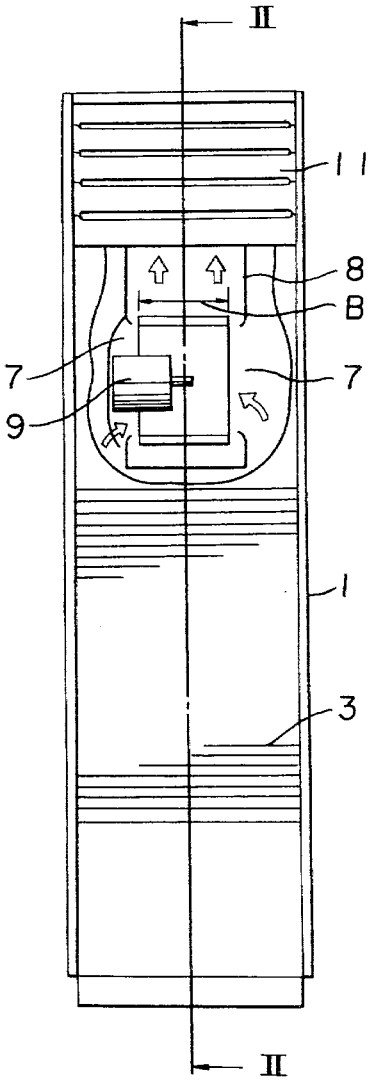
FIG. 1 PRIOR ART
FIG. 1 is a front view of a conventional air conditioner.
Figure 2:
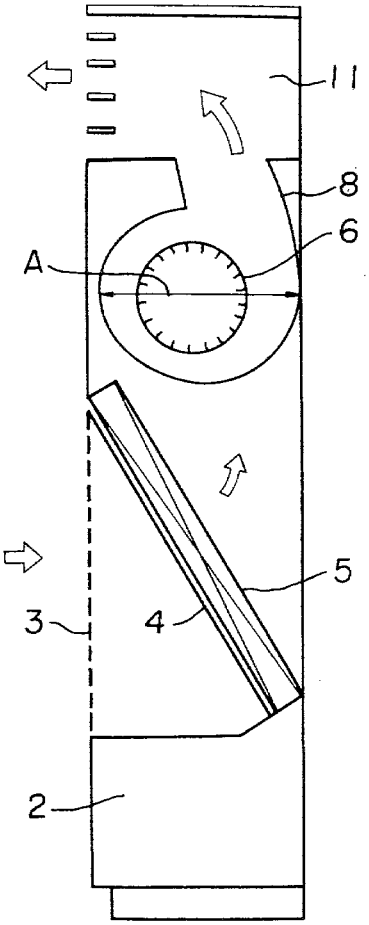
FIG. 2 PRIOR ART
FIG. 2 is a sectional view taken along line II—II in FIG. 1.
Figure 3:
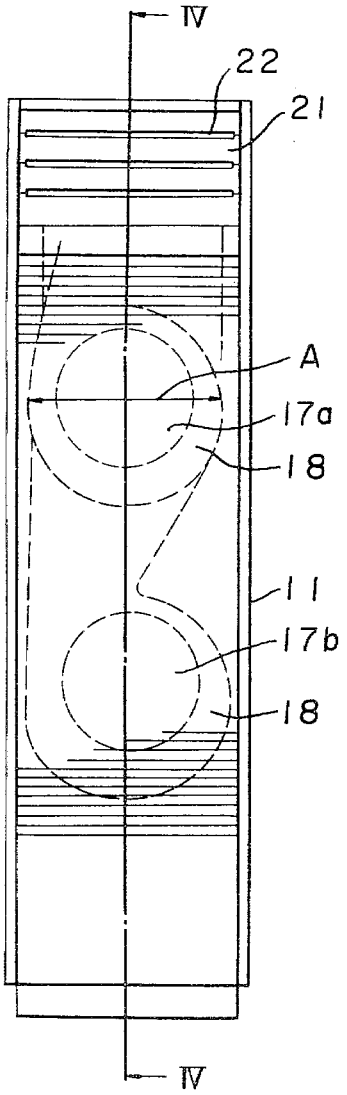
FIG. 3 is a front view of an embodiment of the air conditioner of the present invention.
Figure 4:
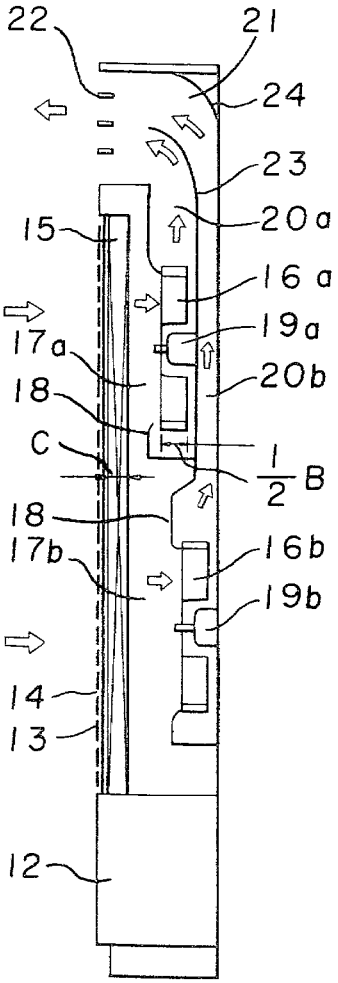
FIG. 4 is a sectional view taken along line IV—IV in FIG. 3.

In FIGS. 3 and 4, the reference numeral 11 designates a container for an air conditioner which is made of a material such as sheet metal; 12 designates a machinery chamber provided in the lower portion of the container 11 to contain wiring, piping (not shown) and so on; 13 designates a suction grille placed in the front of the container; 14 designates an air filter set adjacent to the suction grille 13 for removing dust in the air and 15 designates a heat exchanger having a thickness C and placed in a substantially vertical direction at the rear of the air filter. Two multiblade type blowers **16*a* and 16*b* such as a single-suction type squirrel cage fan or turbo fan are vertically arranged at the rear of the heat exchanger 15. Intake openings 17*a* and 17*b* for the blowers are so arranged that they extend substantially parallel to the heat exchanger 15, and the length of a sucked-air passage in a direction perpendicular to the plane of said heat exchanger, from the heat exchanger 15 to the intake opening of the lower blower, is greater than that from the heat exchanger 15 to the upper blower. The reference numerals 18*a* and 18*b* designate casings for the blowers 16*a*, 16*b* and 19*a*, 19*b* designate motors for the blowers. An air passage 20*b*, feeding air blown from the lower blower 16*b*, is provided at the rear of the casing 18*a* of the upper blower 16*a*. Another air passage 20*a* is also provided to feed air blown from the upper blower 16*a*. The reference numeral 21 designates a chamber for feeding air towards the front of the air conditioner; 22 designates guide vanes for changing air direction; and 23 as well as 24 designate deflectors placed in the chamber 21**.

In the air conditioner having the structure described above, air in the room is sucked through the suction grille 13 by driving the upper and lower blowers, passing through the air filter 14 to the heat exchanger 15 where the air is heat-exchanged. The heat-exchanged air is fed from each suction inlet 17*a*, 17*b* through each passage shown by arrow marks to the deflectors 23,24 placed in the chamber 21, at the end of which the separate flows of air are combined to be blown into the room.

In the embodiment of the present invention, the position of the casings is turned by 90° from that of the conventional casing. Therefore, the blower dimension shown by the character A can be the width of the conventional blower and the dimension of the blower shown by the character B can be ½ that of the conventional blower if the feeding rate of air and the diameter of blades are the same as in the conventional blower because the two single-suction blowers are used instead of the conventional dual suction blower. The depth of the heat exchanger can be reduced because the sucking area of the heat exchanger can be larger than that of the conventional heat exchanger.

In the present invention, the air passage for the lower blower is provided at the rear of the casing of the upper blower and the deflectors 23 and 24 are mounted in the chamber 21 so that an increase of air pressure loss caused by the sudden diffusion of air blown from the air passage into the chamber, by the combination of air flows from the upper and lower blowers, each having a different rate of flow, and by the non-uniform flow rate at the air outlet portion, can be prevented, thereby reducing the depth of the air passage. As a result, the depth of the container of an air conditioner can be smaller than that of the conventional one while maintaining the width unchanged and without changing the characteristics of noise, output and input etc. so that the area required for the air conditioner can be greatly reduced.

Figure 5:
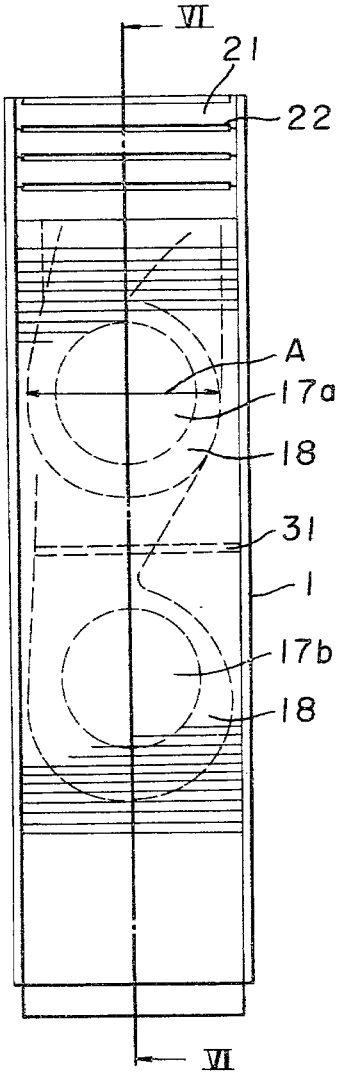
FIG. 5 is a front view of another embodiment of the air conditioner of the present invention.
Figure 6:
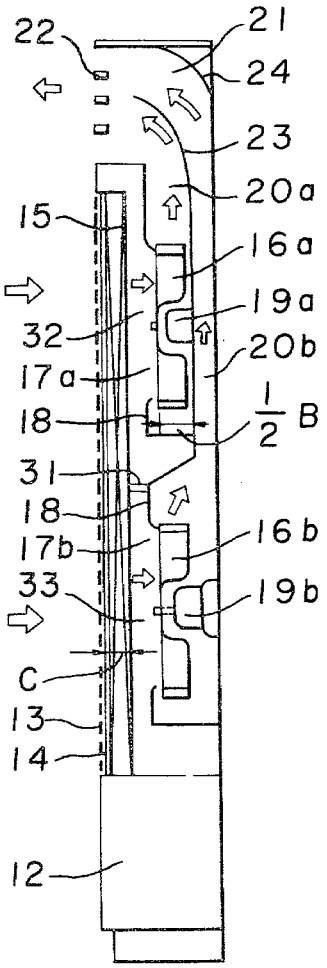
FIG. 6 is a sectional view taken along line VI—VI in FIG. 5.

Another embodiment of the present invention will be described with reference to FIGS. 5 and 6. In FIGS. 5 and 6, the reference numeral 31 designates a partition plate for separating a space defined by the heat exchanger 15 and the casing 18 into two portions. The partition plate 31 provides a space 32 for feeding sucked air to the upper blower and a space 33 for feeding sucked air to the lower blower, thereby eliminating mutual interference between both the blowers 16*a*, 16*b*. The structure of the embodiment shown in FIGS. 5 and 6 is the same as that in FIGS. 3 and 4 except that in FIGS. 5 and 6 the distance from the heat exchanger 15 to the suction inlet 17*a* is the same as that from the heat exchanger 15 to the suction inlet 17*b*; the same reference numerals designate the same or corresponding parts.

In the air conditioner having the structure described above, air in the room is sucked through the suction grille 13 passing through the air filter 14 to the heat exchanger 15 where the air is heat-exchanged. The heat-exchanged air is fed from each suction inlet 17*a* or 17*b* through each passage shown by arrow marks to the deflectors 23 and 24 placed in the chamber 21, at the end of which the separate flows of air are combined to be blown into the room. With this structure, the embodiment of the present invention provides the following effect in addition to the effect described in relation to the former embodiment. The sucked-air passages and the air-feeding passages of the upper blower 16*a* and the lower blower 16*b* have different air-flow resistances. This causes difficulty in the determination of the flow rate characteristics of the blowers. Accordingly, the suctioned-air passage is split by the partition plate 31 to form independent spaces 32, 33 for air passage for the upper and lower blowers thereby allowing easy determination of the characteristics for each of the blowers.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An air conditioner comprising:

a casing having a front and a rear;

an air suction grille adjacent said front of said casing;

a heat exchanger positioned adjacent, and to the rear of, said grille;

an inner casing positioned to the rear of said heat exchanger, said inner casing having at least an upper and a lower suction inlet facing said heat exchanger, the perpendicular distance between said heat exchanger and said lower inlet being greater than the perpendicular distance between said heat exchanger and said upper inlet;

a multiblade blower facing each of said inlets from the rear thereof, a casing outlet; and first and second air passages respectively connected between the blowers of said upper and lower inlets and said outlet, said second air passage extending between said rear of said casing and said blower of said upper inlet.

2. An air conditioner according to claim 1 wherein said heat exchanger is placed substantially parallel to said first and second suction inlets.

3. An air conditioner according to claim 1 wherein said first and second blowers include separate motors.

4. An air conditioner according to claim 1 wherein said first and second multiblade type blowers are squirrel cage or turbo fans.

5. The air conditioner of claim 1 including at least one air deflector adjacent said casing outlet.

6. An air conditioner according to claim 5 wherein said at least one deflector comprises a first deflector placed in said first air passage and a second deflector placed in said second air passage.

7. The air conditioner of claim 1 including means for preventing air flow between a portion of said heat exchanger facing said upper inlet and a portion of said heat exchanger facing said lower inlet.

8. An air conditioner according to claim 7 wherein said means for preventing comprises a partition plate.

9. An air conditioner comprising:

a casing having a front and a rear;

an air suction grille adjacent said front of said casing;

a heat exchanger positioned adjacent, and to the rear of, said grille;

an inner casing positioned to the rear of said heat exchanger, said inner casing having at least an upper and a lower suction inlet facing said heat exchanger;

a partition plate extending between said heat exchanger and said inner casing, said partition plate being positioned so as to prevent air flow between a portion of said heat exchanger facing said upper inlet and a portion of said heat exchanger facing said lower inlet;

a multiblade blower facing each of said inlets from the rear thereof;

a casing outlet; and first and second air passages respectively connected between the blowers of said upper and lower inlets and said outlet, said second air passage extending between said rear of said casing and said blower of said upper inlet.

10. An air conditioner according to claim 9 wherein said heat exchanger is placed substantially parallel to said inner casing.

* * * * *